United States Patent [19]

Mosburger et al.

[11] 4,116,399

[45] Sep. 26, 1978

[54] DEVICE FOR AUTOMATICALLY DETECTING THE END OF A WEB AND SPLICING A NEW WEB THERETO

[75] Inventors: Hans Mosburger, Weiherhammer; Christoph Reis, Etzenricht, both of Fed. Rep. of Germany

[73] Assignee: BHS-Bayerische Berg-, Hütten- und Salzwerke Aktiengesellschaft, Munich, Fed. Rep. of Germany

[21] Appl. No.: 803,673

[22] Filed: Jun. 6, 1977

[30] Foreign Application Priority Data

Jun. 16, 1976 [DE] Fed. Rep. of Germany ..... 2627103

[51] Int. Cl.[2] ..... B65H 19/16; B65H 19/08

[52] U.S. Cl. ..... 242/58.4; 156/504

[58] Field of Search ..... 242/58.1, 58.3, 58.4, 242/58.5; 156/502, 504, 507

[56] References Cited

U.S. PATENT DOCUMENTS

| | | | |
|---|---|---|---|
| 3,298,890 | 1/1967 | Hellemans | 242/58.4 |
| 3,586,006 | 6/1971 | Wendt | 242/58.4 |
| 3,858,819 | 1/1975 | Butler | 242/58.3 |
| 3,891,158 | 6/1975 | Shearon | 242/58.1 |
| 3,948,715 | 4/1976 | Tokuno | 242/58.1 X |
| 3,974,490 | 8/1976 | Mori | 242/58.1 |

*Primary Examiner*—Edward J. McCarthy

*Attorney, Agent, or Firm*—Silverman, Cass & Singer, Ltd.

[57] ABSTRACT

Apparatus for automatically detecting the end of or a tear in a web travelling through a corrugated cardboard installation or the like. A web sensing device having mutually opposed sensors positioned adjacent each edge of the web detects web tears or the end of the web. Automatic execution of a web splicing operation thereupon is effected by a control device which activates web-splicing means.

9 Claims, 3 Drawing Figures

DEVICE FOR AUTOMATICALLY DETECTING THE END OF A WEB AND SPLICING A NEW WEB THERETO

BACKGROUND OF THE INVENTION

1. Field of the Invention

This invention relates generally to a device for automatically detecting the end of a web, or of a break in the web, and for splicing therewith a new web. More particularly, the invention is intended for use in corrugated cardboard installations having a feed roller for feeding a web roll and preparing a new web roll for feeding through the installation when the first has been exhausted or breaks.

2. Description of the Prior Art

Corrugated cardboard installations with which the invention is intended for use generally include a control device which is movable, in dependence upon the feed web roll, into a state of readiness for automatic activation of a web-splicing operation. Such devices include web-sensing means which activate a control device to initiate splicing when the end of the web is reached or in the event a break in the web occurs. The control device controls operation of web-splicing means which include a web brake having a web storage space from which a fresh web supply is withdrawn during the web-splicing operation.

In order to achieve continuous feed of strip material to a processing machine, it is necessary to attach to the web which is being run to the machine on a first web roll a second web on a new supply roll at precisely the right time before the first web roll is exhausted. In order to keep waste of web material at a minimum, the first web roll should be unrolled as far as possible before the second web is attached.

A problem common to running a web of material through a processing machine is that the unused turns of web material at the end of the web roll may become damaged on the outer edges thereof, such that the web will tear before the roll is completely empty. After such a break in the web, the web must be re-fed into the processing machine resulting in down time of the machine. Furthermore, there is always a considerable amount of waste when a break occurs. It therefore is desirable to effect a web splicing operation at a time when there is as little as possible unused material on the web roll, and yet not too late such that a web break or tear may occur. A consideration in this regard is that when paper webs of relatively low quality are used in corrugated cardboard installations, the likelihood of a break near the end of the roll is high; even the slightest damage to such webs may result in breaking of the web.

It is known to employ devices for automatically splicing web material in web feeding installations. One such device is disclosed in U.S. Pat. No. 3,891,158 in which a control device is activated when the web roll reaches a given coil diameter. At the same time, the speed of the web running off the roll is slowed by a brake. At a subsequent work station, operations on the web supply continue. Sensors monitor the web which is travelling off the roll at decreased speed and detect any break or the end of the web. After the detection of such a break or the end, the feeding web is fully braked and stopped and the beginning of the new web is brought to the running-out end and attached to it. Thereupon the brake is released and the new web attached to the old web end is drawn off with increasing speed. The disadvantage with the patented device is that it requires extensive control equipment, as well as a large amount of web storage area. Additionally, such known devices are not capable of detecting web tears which may start at the edge of the web. If a web tear, as opposed to a break, is not immediately detected, activation of the web splicing process will take place too late. In such instances, automatic splicing operations are not practicable.

SUMMARY OF THE INVENTION

The purpose of the present invention is to improve upon the aforesaid known device in such a way that web splicing operations take place even in the case of a tear in the web edge. The invention also provides a construction which is less complex and thus cheaper than the prior known device; further, the invention provides for web storage which requires less space than in the prior device.

The invention solves the aforementioned problems by providing a web-sensing device having mutually opposed sensors positioned adjacent each web edge so as to detect web defects in the form of web edge tears. Such device enables timely activation and completely automatic execution of web splicing even when low quality web material is in use.

Further, in order to automatically determine the proper location of a web edge in the case of varying widths of a paper web, in addition to detecting a web edge tear, in another form of the invention the web-sensing device includes a photoelectric sensing system in which pairs of sensors are positioned adjacent to the web edge. For this purpose, each sensor pair is displaceable by a correction member from a first base position transverse to the running direction of the web, into a second sensing position. In this manner it is possible for the sensing device to be automatically adjusted to any web width and at the same time the sensing device detects any web edge tears.

According to a further aspect of the invention, the control device is moved into its readiness stage by a pre-adjustable sensor which reacts to the coil diameter of the supply web roll. Preferably, such movement of the control device is effected by a photoelectric sensor.

Additionally, the invention provides for decreased storage space required for the paper web supply. In this regard, the output of the electrical control device is connected to a following processing machine whose operating speed is reduced to a preselected value upon emission of the preparatory signal, and is again increased at the end of the web-splicing operation.

Other objects of the invention will occur to those skilled in the art as a description of the invention proceeds in connection with which a preferred embodiment is illustrated in the accompanying drawing and set forth in the accompanying specification.

DESCRIPTION OF THE PREFERRED EMBODIMENT

Figure 1:
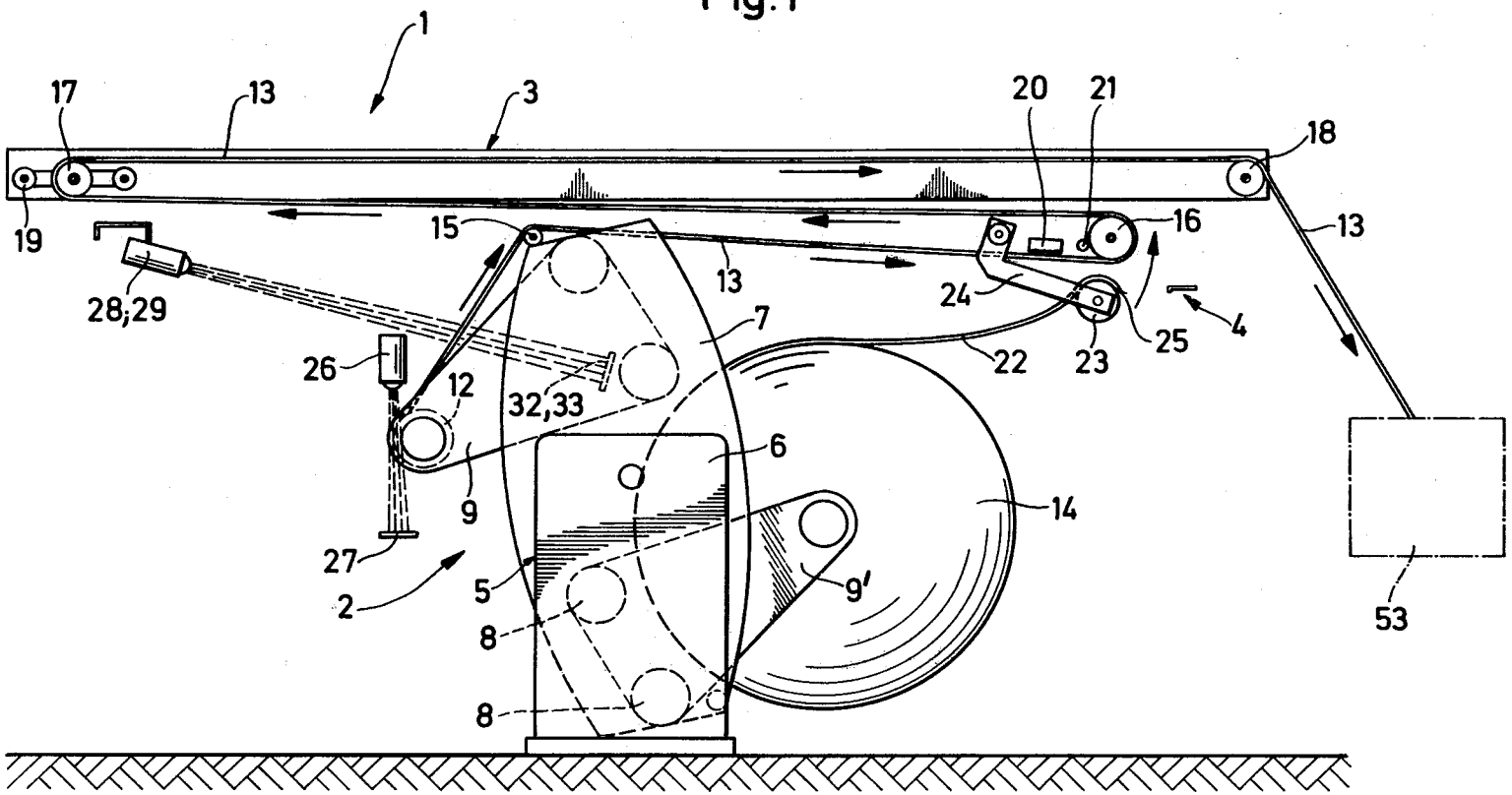
FIG. 1 is a schematic side view of a web splicing apparatus in a corrugated cardboard installation.

Referring to the drawings, the splicer 1 in a corrugated cardboard installation comprises a feeder roller 2, a web storage space 3 and a device for stopping, splicing and separating the web 4.

The feeder 2 may be of any suitable known design. As shown, the feeder 2 consists, for example, of a feeder roller support 5 with two vertical sides 6 rigidly connected to each other. Positioned between the sides 6 are pivoting supports 7 which are connected to each other by means of bearing shafts 8. Parallel arms 9 are disposed on the bearing shafts 8. Facing rotating cones 10 are located at the free ends of the arms 9. The rotating cones 10 are operable together and acted upon by a braking device 11, the braking power of which is adjustable. The roller 12 of the feeding web 13 is centered by the cones 10. A new roll 14 of web material rests in preparation on the cones of the arms 9'. The feeding web 13 is trained over a guide roller 15 of the feed roller 2 to a guide roller 16 in the web storage space 3. The web 13 runs in the form of a loop from the guide roller 16 in the web storage space 3 over a storage loop 17 to an additional guide roller 18. The web 13 then leaves the storage space 3 and moves to another cardboard processing machine, not shown.

The movable storage roller is supported in a carriage 19 which runs along the storage space 3, pulled by a drive mechanism (not shown), e.g., a hydromotor or the like, into the storage space shown in FIG. 1 (left end of the storage space); in this position the carriage 19 is held by a releasable catch, not shown.

The web holding, splicing and separating device 4 has a vacuum brake 20 positioned in front of the guide roller 16 of the web storer for the feeding web 13, and a transverse cutting device 21, the operation of which is controlled by an electrical control device. The electrical control device also controls the catch device of the storage carriage 19.

The web 22 of the prepared new roll 14 is led to a pressure roller which acts as a splicing device and which is supported on pivoting arms 24. The pivoting arms 24 can be pivoted, when released by the electrical control device, in the direction of the arrow (FIG. 1), counterclockwise, whereby the end 25 of the web 22, which is provided with an adhesive strip, can be fastened to the feeding web 13.

The diameter of the roll 12 of the feeding web 13 is sensed by a sensing device, consisting of a photocell with light source 26 and a reflector in the form of a mirror 27. The photocell with light source 26 may be movable to enable adjustment to a pre-selected coil diameter. As soon as the predetermined coil diameter has been reached, the beam emitted by the light source reaches the reflector 27 and is reflected to the photocell 26, whereby the photocell 26 emits a signal to the control device. Once the signal with respect to pre-determined coil diameter is received by the control device, the device is in a ready state for execution of an automatic splicing operation to be effected when an additional sensing device activates the splicing operation.

The additional sensing device consists of photocells with light sources 28, 29 which are positioned at a distance from each other adjacent to each edge 30 and 31 respectively of the web. There is a reflector 32, 33 for each photocell and light source pair 28, 29. The reflectors are attached to the arms 9 of the feed roll support 5 and lie transverse to the long axis of the feeding web 13 and extend a certain distance into the web. Each photocell and light source pair 28, 29 is connected to a correction element 34, 35 which is controllable by the electrical control device. These correction elements 34, 35 can shift the photocell light source pairs 28, 29 from their first position I shown in FIG. 2, to an outer second position II and back again.

The photocells with light sources 28, 29 and correction elements 34, 35 are installed on a traverse 36 disposed transverse to the web. The photocell light sources 28, 29 are attached firmly to slides carried on said traverse 36.

Figure 2:
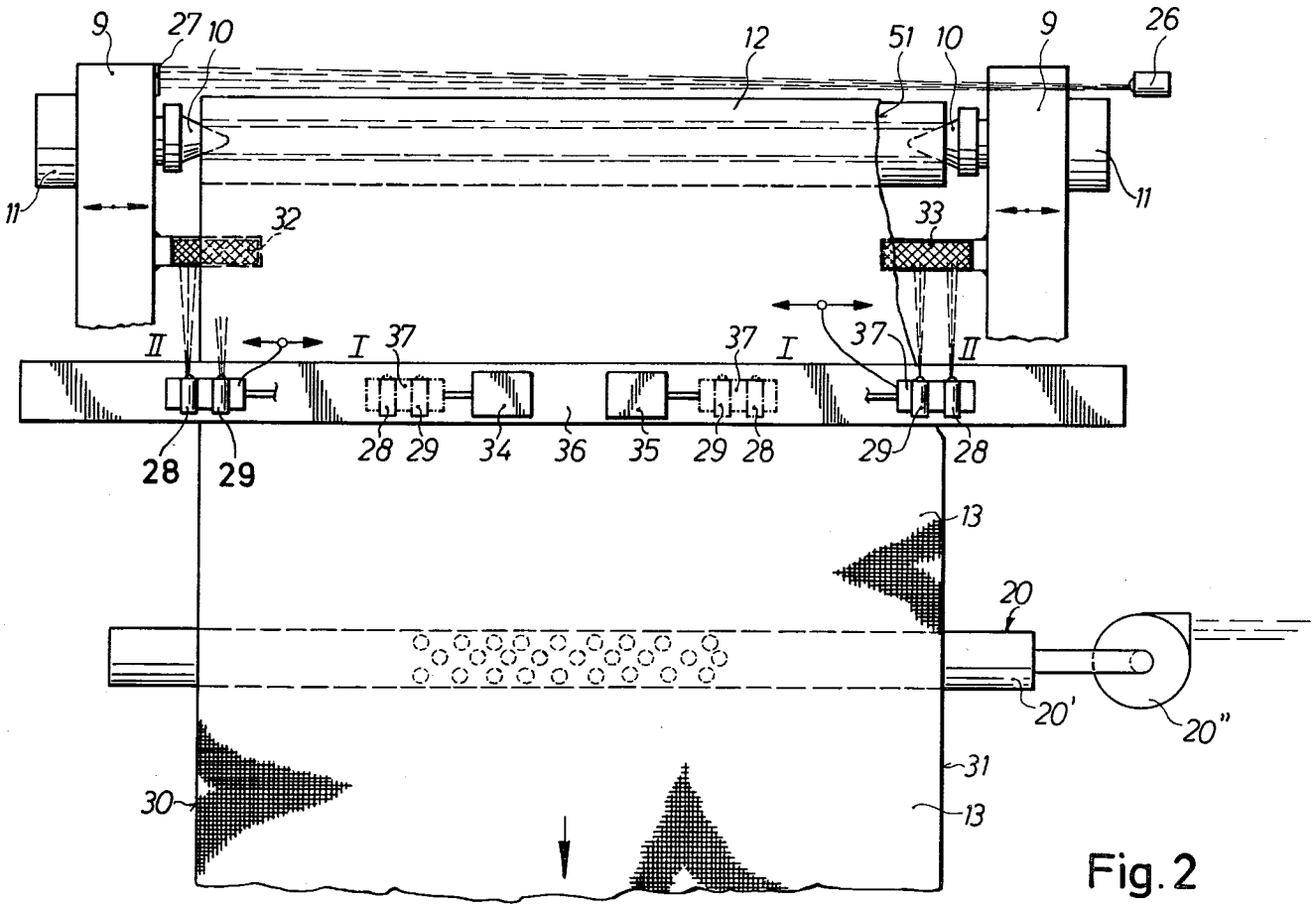
FIG. 2 is a front view thereof.

As best seen in FIG. 2, the vacuum brake consists of a perforated suction tube 20', over which the feeding web 13 is led. One end of the tube is connected to a blower 20 which can be switched on and off. On and off operation of the blower 20 is controlled by the electrical control device.

Figure 3:
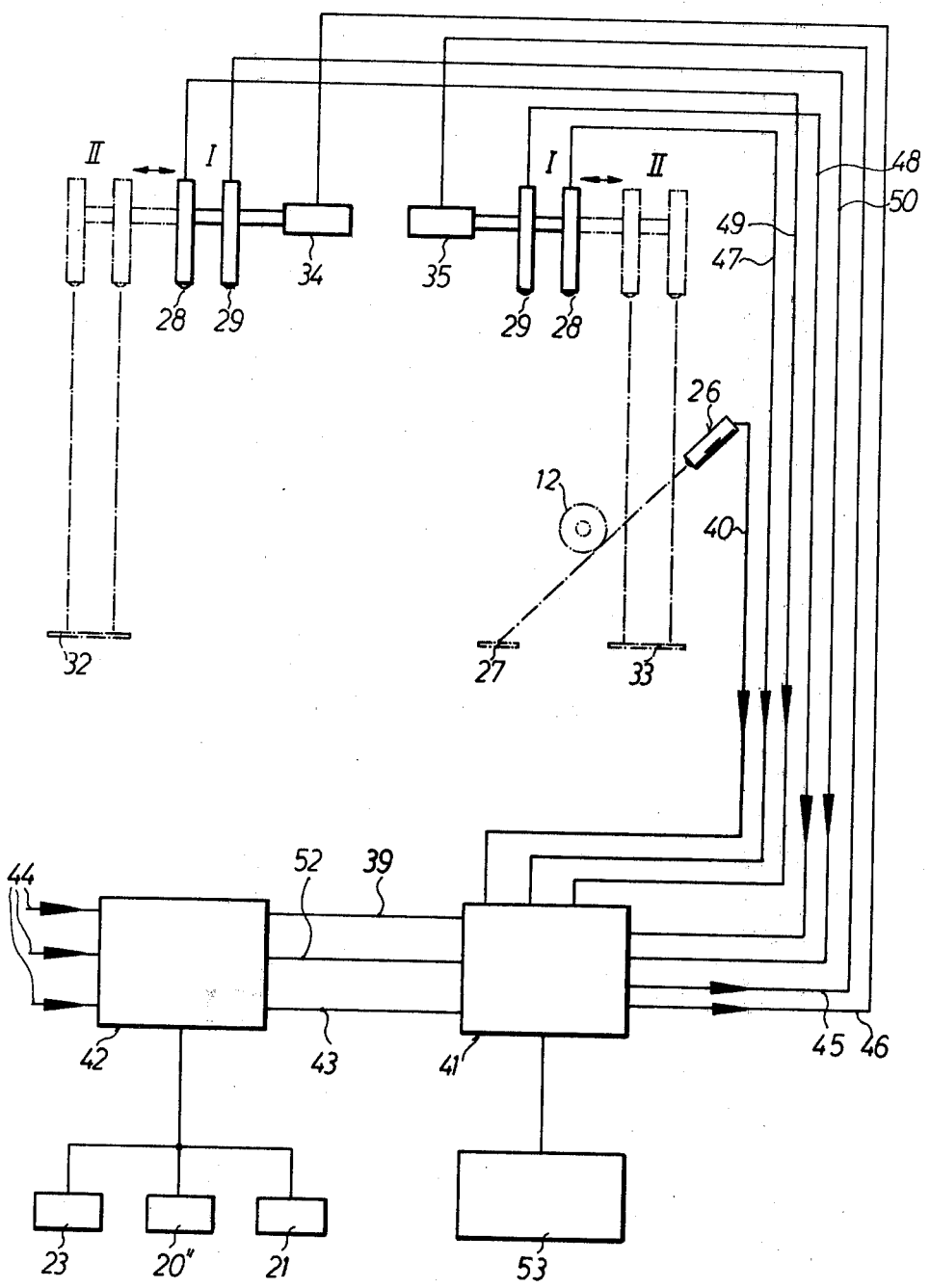
FIG. 3 is an electrical block schematic thereof.

According to the block schematic shown in FIG. 3, the photocell 26 can give a signal over the circuit 40 to the electrical control device 41 when the pre-selected coil diameter of the web roll 12 is reached and light from the reflector 27 is reflected to the photocell 26. The electrical control device 41 is then prepared for the execution of an automatic splicing operation.

The preparatory condition of the electrical control device 41 is possible only if the additional electrical control device 42 has given an output signal to the control device 41; this occurs when all the devices necessary for the splicing operation are in their readiness positions. These readiness positions, e.g., storage output positions, etc., are fed via the inputs 44 to the control device 42.

Preferably, upon emission of a signal by the photocell 26, the control device 41 delivers a signal to the processing machine behind the storer 3. The signal is transmitted through the circuit 39 and the control device 42, for the purpose of reducing the working speed of the processing machine.

Upon input of a signal from the photocell 26 to the control device 41, the latter releases the correction elements 34, 35, which are connected via the circuits 45, 46 to the control device. The correction elements 34, 35 move the slides 37 for the photocells 28, 29 from position I outward to position II. The pair of photocells 28, 29 adjacent to the left web edge 31 is connected to the control device 41 by means of circuits 47, 48, and the pair 28, 29 adjacent to the right web edge 30, by way of circuits 49, 50.

When the two sensor pairs 28, 29 are moved from their position I to the position II, and upon passing beyond the particular respective edge of the web 13, the respective outer photocell sensor 28 delivers a signal by way of circuit 47 or 49 to the control device 41. The action causes the control device 41 to switch off the correction elements 34 or 35, respectively. The sensor devices remain in this last-assumed position.

If, as this operation continues, the left edge 31 of the web tears as indicated at 51 in FIG. 2, the inner-located photocell 29 also receives light by reason of uncovering of the reflector 33 in this area and transmits a signal to the control device through circuit 48. This signal fully activates the vacuum brake 20, which in a given case may already be in operation under partial load, whereby the running web 13 is slowed down or stopped. The activation signal of the control device 41 is given through the circuit 52 to the supplementary control device 42. This control device 42 is in turn connected to blower 20" for the vacuum brake, or with filtered-air impellers, in such a way that the running web 13 is stopped immediately by the vacuum brake 20.

Since the feeding web 13 is braked or stopped by the vacuum brake 20, but the following processing machine 53 continues to run, the length of web necessary for the continued handling is taken from the storage space 3. The storage roller 17 moves with the storage carriage 19 from its storage position (left position) little by little toward the guide roller 18.

Simultaneously with activation of the vacuum brake 20, the pivoting drive for the pressure roller 23 is also activated by the control device 42, whereby the end of the new web 22 of the roller 14 is spliced to the stopped feeding web 13.

By time delay or sequence operation the transverse cutting device 21, which cuts off the web 13, is activated by the control devices 41, 42.

Finally, the correction members 34, 35 receive via their circuits 45 and 46 a signal to move their sensors out of position II back to position I. The pressure roller 23 returns to its original position. The web 22, which is fixed to the end of the feeding roll 23, is pulled along and thereby pulled off of the roller 14. The drive for the storage carrier 19 moves the storage roller 17 little by little back into its left-hand storage position. The following processing machine 53 is again brought up to its normal speed.

After all these devices have reached their original positions and these positions are again announced via the inputs 44 to the control device 42 as preparedness position, the automatic splicing operation is completed.

The same splicing operation is activated when the feeding web 13 is unrolled to its end without encountering a tear 51. In this case, likewise, the photoelectric sensors 28, 29 receive light when the end of the web passes the reflectors 32, 33 and activate the control device by means of their signals.

It is to be understood that instead of photoelectric sensors 26, 27, 28, 29, 32 and 33, other sensing elements, e.g., mechanical mechanisms, can be used.

We claim:

1. A device for automatically detecting the end of or a tear in a web of material having a pair of longitudinal edges travelling through a corrugated cardboard installation or the like and for splicing said end or tear with a new web, the installation including a feed roller for a feed web roll and a prepared new web roll, said device comprising, control means movable into a preparatory stage for automatic activation of said web splicing, web sensing means including at least one sensor positioned at each of said longitudinal edges of said web, a web brake to slow the speed of the web through the installation, and a web storage space from which a supply of web material is removed during the web splicing, whereby when the end of the web is reached or when a tear therein occurs said sensors detect the same and deliver a signal to the control means to effect splicing of a new web.

2. A device as claimed in claim 1 in which said web sensing means comprise a photoelectric sensor including a pair of sensors for each web edge.

3. A device as claimed in claim 2 including a correction member associated with each sensor pair to move the same transversely with respect to the web from a first position to a sensing position.

4. A device as claimed in claim 2 in which each sensor of each sensor pair is connected to inputs of said control means.

5. A device as claimed in claim 1 including an adjustable sensor for sensing the coil diameter of the feed web roll and for signalling the control means to move to a preparatory condition.

6. A device as claimed in claim 5 in which said adjustable sensor is a photoelectric sensor.

7. A device as claimed in claim 5 in which said adjustable sensor signals the web brake to move from a partial load condition to a full load condition at the time of activation of said web splicing.

8. A device as claimed in claim 7 in which the web brake is a vacuum brake.

9. A device as claimed in claim 1 in which a following processing machine is connected to an output of said control means, the operating speed of the following processing machine being reduced to a preselected value upon signal from said control means and is increased again to its original speed following web splicing.

* * * * *